United States Patent [19]

Ohta et al.

[11] 4,108,656

[45] Aug. 22, 1978

[54] PHOTOCONDUCTIVE MEMBER HAVING A CHARGE GENERATING PIGMENT AND 2,4,7-TRINITROTHIOXANTHONE AS CHARGE TRANSPORT MATERIAL

[75] Inventors: Masafumi Ohta; Mitsuru Hashimoto; Akio Kozima, all of Tokyo, Japan

[73] Assignee: Ricoh Co., Ltd., Tokyo, Japan

[21] Appl. No.: 751,529

[22] Filed: Dec. 16, 1976

[30] Foreign Application Priority Data

Dec. 24, 1975 [JP] Japan ..... 50-154428

[51] Int. Cl.[2] ..... G03G 5/02

[52] U.S. Cl. ..... 96/1.5 R; 96/1.6

[58] Field of Search ..... 96/1.5, 1.6

[56] References Cited

U.S. PATENT DOCUMENTS

| | | | |
|---|---|---|---|
| 3,159,483 | 12/1964 | Behmenburg et al. | 96/1.5 |
| 3,287,114 | 11/1966 | Hoegl | 96/1.5 |
| 3,850,630 | 11/1974 | Regensburger et al. | 96/1.5 |
| 3,870,516 | 3/1975 | Smith et al. | 96/1.6 X |
| 3,877,935 | 4/1975 | Regensburger | 96/1.5 |
| 3,879,200 | 4/1975 | Regensburger et al. | 96/1.5 |
| 3,894,868 | 7/1975 | Regensburger et al. | 96/1.5 |
| 3,904,407 | 9/1975 | Regensburger et al. | 96/1.5 |
| 3,928,034 | 12/1975 | Regensburger | 96/1.5 |

FOREIGN PATENT DOCUMENTS

| | | | |
|---|---|---|---|
| 75-25231 | 3/1975 | Japan | 96/1.6 |

OTHER PUBLICATIONS

Chemical Abstracts, vol. 83, 1975, 139842h.

Chemical Abstracts, 1967–1971, Subject Index, p. 31179s.

*Primary Examiner*—John T. Goolkasian

*Attorney, Agent, or Firm*—Blanchard, Flynn, Thiel, Boutell & Tanis

[57] ABSTRACT

A photoconductive sensitive material composed of a conductive support and a photoconductive layer formed thereon, said photoconductive layer consisting essentially of charge generating pigment(s), 2,4,7-trinitrothioxanthone and resinous binder.

9 Claims, 2 Drawing Figures

PHOTOCONDUCTIVE MEMBER HAVING A CHARGE GENERATING PIGMENT AND 2,4,7-TRINITROTHIOXANTHONE AS CHARGE TRANSPORT MATERIAL

BACKGROUND OF THE INVENTION (a) Field of the Invention

The present invention relates to a photoconductive sensitive material for use in electrophotography.

(b) Description of the Prior Art

In Japanese Patent Publication No. 16198/1968 there is disclosed a photoconductive sensitive material comprising a layer of selenium (Se) deposited through evaporation on a conductive support and a layer of polyvinyl carbazole on said layer of Se. This photosensitive material is so designed as to give rise to electrons and holes in the Se layer by exposing it to light and to transfer the thus generated holes onto the surface of the photosensitive material by virtue of said layer of polyvinyl carbazole. In other words, Se works as a charge generating substance and polyvinyl carbazole works as a charge transferring substance.

In Japanese Patent Open No. 11536/1972 and Japanese Patent Open No. 11537/1972 there is disclosed a photosensitive material for use in electrophotography wherein a charge generating substance is mixed with a charge transferring substance to constitute one and the same layer.

Those photosensitive materials employing a charge generating substance in combination with a charge transferring substance promise an enhanced sensitivity compared with a photosensitive material employing a photosensitive layer wherein ZnO resin is dispersed therein or one employing a photosensitive layer of polyvinyl carbazole. Besides, various ways have been tried to improve the photosensitive materials of the type comprising the combination of a charge generating substance and a charge transferring substance. However, the proposals made to date are no more than those disclosed in Japanese Patent Open No. 18543/1972, Japanese Patent Open No. 18544/1972, Japanese Patent Open No. 30331/1972, Japanese Patent No. 30332/1972, etc. which mostly deal with the improvement of the charge generating substances. An attempt to improve the charge transferring substance is unprecedented.

As the charge transferring substances hitherto known, there are, for instance, polyvinyl carbazole, polyvinyl anthracene, 2,4,7-trinitro-9-fluorenone, 2,4,5,7-tetranitrofluorenone, dinitroanthracene, dinitroacridene, dinitroanthraquinone, 2-phenyl anthracene, 2-phenyl indole, etc.

However, as a matter of fact, the conventional photosensitive materials prepared by employing these known charge transferring substances are still insufficient in sensitivity.

SUMMARY OF THE INVENTION

A principal object of the present invention is to provide a photoconductive sensitive material having a high sensitivity.

Another object of the present invention is to provide a photoconductive sensitive material which always renders a clear-cut copied image even when used repeatedly.

A further object of the present invention is to provide a photoconductive sensitive material which has an excellent flexibility.

The present inventors have conducted a series of studies and examinations extending over a long period of time with respect to photoconductive sensitive materials, and they have found that 2,4,7-trinitrothioxanthone has suitable properties for use as a charge transfer medium, and the use thereof in combination with appropriate charge generating pigments provides a photoconductive sensitive material having very desirable properties. The present invention has been accomplished on the basis of this finding.

To be precise, the present invention relates to (1) a photoconductive sensitive material prepared by forming a layer (or photoconductive layer) consisting essentially of charge generating pigment(s), 2,4,7-trinitrothioxanthone and resinous binder on a conductive support and (2) a photoconductive sensitive material prepared by forming a thin layer of charge generating pigment(s) (hereinafter simply called 'charge generating layer') on a conductive support and further forming thereon a layer consisting essentially of 2,4,7-trinitrothioxanthone and resinous binder (hereinafter simply called 'charge transfer layer'). In this context, in the case of the photosensitive material (2) above, the photoconductive layer thereof consists of a charge generating layer and a charge transfer layer.

BRIEF DESCRIPTION OF THE DRAWING

The appended

Figure 1:
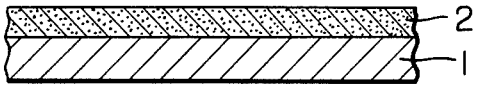
FIG. 1 and FIG. 2 are schematic sectional views, on an enlarged scale, illustrating two typical examples of the photoconductive sensitive material according to the present invention. In the drawings, the reference numeral 1 denotes the conductive support, 2,2'-denote the photoconductive layer, 3 denotes the charge generating layer and 4 denotes the charge transfer layer, and the photoconductive layer 2' consists of said charge generating layer 3 and charge transfer layer 4.

The photosensitive material in FIG. 1 is one prepared by forming a layer consisting essentially of charge generating pigment(s), 2,4,7-trinitrothioxanthone and resinous binder (to wit, photoconductive layer 2) on a conductive support 1 made of paper processed for conductivity, synthetic resin film deposited with aluminum through evaporation, metal plate (e.g., aluminum plate) or the like.

Figure 2:
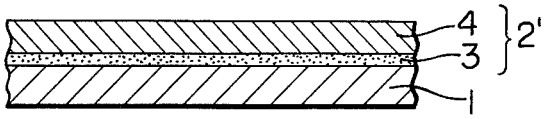

Meanwhile, the photosensitive material in FIG. 2 is one prepared by forming a thin layer consisting of charge generating pigment(s) alone or consisting of charge generating pigment(s) together with resinous binder (to wit, charge generating layer 3) on a conductive support 1 and further forming thereon a charge transfer layer 4 consisting of 2,4,7-trinitrothioxanthone and resinous binder.

DETAILED DESCRIPTION OF THE INVENTION

The present invention is characterized by the combined use of charge generating pigment(s) and 2,4,7-trinitrothioxanthone as a charge transfer medium.

2,4,7-trinitrothioxanthone expressed by the general formula

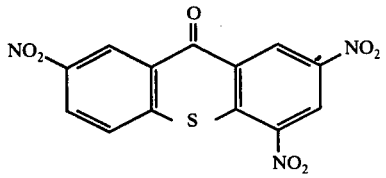

for use in the present invention is a well-known compound and is easy to synthesize or is available on the market.

As the charge generating pigment for use in the present invention, any of the well-known charge generating substances is applicable. To cite applicable substances, there are, for instance, azo-type, xanthene-type, violanthrone-type, phthalocyanine-type, polycyclic quinone-type, indigoid-type, quinacridone-type, bisbenzimidazole-type, perylene-type and indanthrone-type organic pigments, and such inorganic pigments as Se, SeTe, CdS, CdSSe, etc. These pigments can be applied either individually or by combining two or more of them.

As the resinous binder for use in preparing a photoconductive sensitive material according to the present invention, varieties of well-known resins are applicable. And, particularly the use of polyester resin, acrylic resin, silicone resin, novolak resin, polyketone resin, substituted or non-substituted polyvinyl carbazole resin, substituted or non-substituted pyreneformaldehyde resin, etc. is desirable. Further, as the resinous binder for use in the present invention, resins having photoconductivity inherently, such as poly-N-vinyl carbazole or derivative thereof and other photoconductors may be used as well. These resins can be applied either individually or by combining two or more of them.

As described above, the present invention relates to a photoconductive sensitive material prepared by using charge generating pigment(s) and 2,4,7-trinitrothioxanthone jointly, and examples of embodiments thereof are as illustrated by FIG. 1 and FIG. 2.

In the case of the photosensitive material exemplified in FIG. 1, the charge generating pigment is in the state of being dispersed in the resinous binder, and accordingly, the particle size thereof is less than 5 $\mu$, preferably less than 1 $\mu$ in diameter. And, the appropriate amount of the charge generating pigment(s) contained in the photoconductive layer 2 of a photosensitive material of the type shown in FIG. 1 is in the range of 0.1–30 wt.% and the appropriate amount of 2,4,7-trinitrothioxanthone contained in the same is in the range of 1–60 wt.%. Besides, a proper amount of a known sensitizer may be contained therein as occasion demands. The appropriate thickness of the photoconductive layer 2 is in the range of 5–100 $\mu$.

As to the photosensitive material exemplified in FIG. 2, in the case where the charge generating layer 3 consists of charge generating pigment(s) and resinous binder, it is preferable to apply the least possible amount of resinous binder. The thickness of the charge generating layer 3 is in the range of 0.05–20 $\mu$, preferably 0.1–5 $\mu$. As for the amount of 2,4,7-trinitrothioxanthone to be contained in the charge transfer layer 4, it is desirable that this be as much as possible, but in view of the condition for preparation of the photosensitive material, the appropriate amount is in the range of 20–60 wt.%. The thickness of this charge transfer layer 4 is in the range of 5–100 $\mu$. Besides, in the case of this three-layer (support 1 - charge generating layer 3 - charge transfer layer 4) type photosensitive material shown in FIG. 2 too, a proper amount of a known sensitizer may be added thereto like in the case of the two-layer (support 1 - photoconductive layer 2) type photosensitive material shown in FIG. 1.

In a photosensitive material according to the present invention, for the purpose of improving the adhesion, electrification characteristic, etc. thereof, a layer of polyamide, vinyl acetate resin; polyurethane and the like or a thin film of aluminum oxide and the like having a thickness in the range of 0.01–1.0 $\mu$ may be interposed between the support 1 and the photoconductive layer 2 or between the support 1 and the photoconductive layer 2' (to wit, between the support 1 and the charge generating layer 3).

In order to prepare a photosensitive material according to the present invention actually, it will do to follow either a procedure comprising dissolving the binder resin in an appropriate solvent, adding said charge generating pigment(s) together with 2,4,7-trinitrothioxanthone to the resulting solution to disperse same thoroughly therein, applying the thus prepared dispersion onto a conductive support and drying thereafter, thereby forming a photoconductive layer (cf. FIG. 1), or a procedure comprising forming a charge generating layer consisting of charge generating pigment(s) alone or, if necessary, a charge generating layer consisting of a mixture of charge generating pigment(s) and resinous binder by depositing through evaporation or the like on a conductive support, further forming thereon a charge transfer layer consisting of a mixture of 2,4,7-trinitrothioxanthone and resinous binder by coating or the like thereby forming a photoconductive layer consisting of charge generating layer and charge transfer layer on said conductive support (cf. FIG. 2).

A photoconductive sensitive material according to the present invention prepared as above is useful in electrophotography, and it has many advantages such that (a) the sensitivity thereof is so high that it does not give rise to residual potential, (b) it shows little fatigue in repeated use and is stable, and (c) it is easy to manufacture.

DESCRIPTION OF THE PREFERRED EMBODIMENTS

EXAMPLE 1

By crushing Dian Blue (color index 21180) within a ball-mill in the presence of tetrahydrofuran (THF), a dispersion containing 2 wt.% of pigment was prepared. By applying this dispersion by means of a doctor blade onto a polyester film deposited with aluminum through evaporation and subjecting it to natural drying, a 1 $\mu$-thick charge generating layer was formed. Subsequently, by applying a THF solution consisting of 2 wt.% of 2,4,7-trinitrothioxanthone and 3 wt.% of polycarbonate (namely, PANLITE L, the manufacture of K. K. TEIJIN) onto said charge generating layer by means of a doctor blade and subjecting it to 30 minutes' drying at 100° C thereby forming a 9 $\mu$-thick charge transfer layer, a three-layer type photoconductive sensitive material was prepared.

The thus prepared photosensitive material was electrified by subjecting it to +6KV corona discharge for 20 seconds by the use of a commercial electrostatic copying material testing device (namely, Model SP428, the manufacture of K. K. KAWAGUCHI DENKI SEISAKUSHO). After leaving the thus electrified photosensitive material standing in a dark place for 20 seconds, the surface potential Vpo (V) thereat was measured. Subsequently, by exposing it to a tungsten lamp by setting the illumination on the surface of photosensitive material at 20 luxes, recording the decay of the surface potential thereat and the time (second) required for said decay by means of a recorder, and seeking the time (second) taken in reducing Vpo by half, the amount of exposure E1/2 was obtained. That is, E1/2 stands for the amount of exposure required for reducing Vpo by half and denotes the sensitivity of the photosensitive material. The value of Vpo and E1/2 thus obtained was 530V and 17 lux.sec., respectively.

It will be understood from this result of measurement that 2,4,7-trinitrothioxanthone in itself is useful as charge transfer medium.

EXAMPLE 2

To a THF solution consisting of 4 parts by weight of poly-N-vinyl carbazole (namely, LUVICAN M170, the manufacture of BASF Inc.) and 1 part by weight of 2,4,7-trinitrothioxanthone was added Dian Blue (C.I. 21180) to the extent of 30 wt.% based on the content of 2,4,7-trinitrothioxanthone and thoroughly dispersed therein by means of a ball-mill. Subsequently, by applying the resulting dispersion onto a polyester film deposited with aluminum through evaporation by means of a doctor blade and subjecting it to 30 minutes' drying at 100° C thereby forming a 12 μ-thick photoconductive layer, a two-layer type photoconductive sensitive material was prepared.

When the thus prepared photosensitive material was evaluated in the same way as in Example 1, the result was as shown in the following table.

| | Vpo | El/2 |
|---|---|---|
| when charged with positive electricity | 820 V | 4.0 lux·sec |
| when charged with negative electricity | 940 V | 7.6 lus·sec |

EXAMPLE 3

By depositing selenium on a 300 μ-thick aluminum plate to the extent of 1 μ in thickness through vacuum evaporation, a charge generating layer was formed thereon. Subsequently, by applying a THF solution consisting of 2 parts by weight of 2,4,7-trinitrothioxanthone and 3 parts by weight of polyester resin (namely, POLYESTER ADHESIVE 49000, the manufacture of Du Pont Inc.) onto said charge generating layer by means of a doctor blade and subjecting it to natural drying followed by drying under reduced pressure thereby forming a 10 μ-thick charge transfer layer, a three-layer type photoconductive sensitive material was prepared.

When the thus prepared photosensitive material was evaluated in the same way as in Example 1, in the case where it was charged with positive electricity, the value of Vpo was 850 V and the value of E1/2 was 20 lux.sec.

EXAMPLE 4

By crushing β type copper phthalocyanine (namely, SUMITOMO CYANINE BLUE, the manufacture of SUMITOMO KAGAKU K. K.) within a ball-mill in the presence of THF, a dispersion of pigment was prepared. By employing this pigment dispersion, a dispersion consisting of 1 part by weight of β type copper phthalocyanine, 12 parts by weight of 2,4,7-trinitroxanthone and 18 parts by weight of polyester resin (namely, POLYESTER ADHESIVE 49000) was prepared. Subsequently, by applying this dispersion onto a polyester film deposited with aluminum through evaporation by means of a doctor blade and subjecting it to 30 minutes' drying at 100° C thereby forming a 16 μ-thick photosensitive layer, a two-layer type photoconductive sensitive material was prepared.

When the thus prepared photosensitive material was evaluated in the same way as in Example 1, in the case where it was charged with negative electricity, the value of Vpo was 890 V and the value of E1/2 was 8.3 lux.sec.

What is claimed is:

1. An electrophotographic plate comprising an electrically conductive substrate and a photoconductive layer overlying said electrically conductive substrate, said photoconductive layer consisting essentially of a mixture of from 0.1 to 30 percent by weight of charge generating pigment having a particle size of less than 5μ, from 1 to 60 percent by weight of 2,4,7-trinitrothioxanthone and the balance is binder resin.

2. An electrophotographic plate according to claim 1, in which said photoconductive layer has a thickness of from 5 to 100μ and said charge generating pigment has a particle size of less than 1μ.

3. An electrophotographic plate according to claim 1, wherein said charge generating pigment consists of at least one pigment selected from the group consisting of azo-type, xanthene-type, violanthrone-type, phthalocyanine-type, polycyclic quinone-type, indigoid-type, quinacridone-type, bisbenzimidazole-type, perylene-type and indanthrone-type organic pigments and Se, SeTe, CdS and CdSSe.

4. An electrophotographic plate according to claim 1, wherein the binder resin consists of at least one resin selected from the group consisting of polyester resin, acrylic resin, silicone resin, novolak resin, polyketone resin, substituted or non-substituted polyvinyl carbazole resin, and substituted or non-substituted pyrene-formaldehyde resin.

5. An electrophotographic plate comprising an electrically conductive substrate, a first layer overlying said substrate, said first layer consisting essentially of charge generating pigment, and a charge transfer layer overlying said first layer, said charge transfer layer consisting essentially of a mixture of from 20 to 60 percent by weight of 2,4,7-trinitrothioxanthone and the balance is binder resin.

6. An electrophotographic plate according to claim 5, wherein said charge generating pigment consists of at least one pigment selected from the group consisting of azo-type, xanthene-type, violanthrone-type, phthalocyanine-type, polycyclic quinone-type, indigoid-type, quinacridone-type, bisbenzimidazole-type; perylene-type and indanthrone-type organic pigments and Se, SeTe, CdS and CdSSe.

7. An electrophotographic plate according to claim 5, wherein the binder resin is at least one resin selected from the group consisting of polyester resin, acrylic resin, silicone resin, novolak resin, polyketone resin, substituted or non-substituted polyvinyl carbazole resin, and substituted or non-substituted pyreneformaldehyde resin.

8. An electrophotographic plate according to claim 5, in which the thickness of said first layer is from 0.05 to 20μ and the thickness of said charge transfer layer is from 5 to 100μ.

9. An electrophotographic plate according to claim 8 in which the thickness of said first layer is from 0.1 to 5μ.

* * * * *